US006447273B1

(12) United States Patent
Nishimura et al.

(10) Patent No.: US 6,447,273 B1
(45) Date of Patent: Sep. 10, 2002

(54) VARIABLE-DELIVERY HIGH-PRESSURE FUEL PUMP

(75) Inventors: Terukazu Nishimura; Shoshi Hidaka, both of Kanagawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/468,118

(22) Filed: Dec. 21, 1999

(30) Foreign Application Priority Data

Dec. 24, 1998 (JP) ..... 10-367948

(51) Int. Cl.[7] ..... F04B 7/00

(52) U.S. Cl. ..... 417/505; 123/446; 123/447; 123/456; 137/614.19; 137/614.2; 417/439

(58) Field of Search ..... 417/505, 439; 123/446, 447, 456; 137/614.19, 614.2

(56) References Cited

U.S. PATENT DOCUMENTS

| | | | | |
|---|---|---|---|---|
| 3,709,639 A | * | 1/1973 | Suda et al. | 417/505 |
| 4,406,267 A | * | 9/1983 | Sharma | 417/505 |
| 4,475,513 A | * | 10/1984 | Flaig et al. | 123/446 |
| 5,230,613 A | * | 7/1993 | Hilsbos et al. | 417/505 |

FOREIGN PATENT DOCUMENTS

| | | |
|---|---|---|
| JP | 6257533 | 9/1994 |
| JP | 2690734 | 8/1997 |

* cited by examiner

*Primary Examiner*—Charles G. Freay
*Assistant Examiner*—William H. Rodriguez
(74) *Attorney, Agent, or Firm*—Browdy and Neimark, P.L.L.C.

(57) ABSTRACT

A variable-delivery high-pressure fuel pump having a pump chamber varying in volume as a plunger moves in and out, an inlet port valve forming a part of chamber walls of the pump chamber, the inlet port valve being opened when a low-pressure fuel is admitted into the pump chamber, while being closed when the admitted fuel is delivered out of the pump chamber, a control chamber on an opposing end of the inlet port valve to receive the low-pressure fuel from the fuel inlet passage, and a control valve for intermittently opening and blocking a fluid communication between the control chamber and the fuel inlet passage. The inlet port valve is a poppet valve made with a valve head having a valve face moving off and reseating against a valve seat in the pump chamber, and a valve stem integral with the valve head and extending out of the pump chamber into the control chamber.

8 Claims, 8 Drawing Sheets

(A)

(B)

(C)

(D)

(E)

VARIABLE-DELIVERY HIGH-PRESSURE FUEL PUMP

BACKGROUND OF THE INVENTION

1. Field of the Invention

The present invention relates to a pump to spray fuel at a high pressure into combustion chambers of an engine and, more particularly, a variable-delivery high-pressure fuel pump to pressurize, meter a fuel and then deliver the metered fuel to the combustion chambers.

2. Description of the Prior Art

For the variable-delivery high-pressure fuel pumps, generally, two types of pumps have been developed one of that is a high-pressure fuel pump 80 of inlet port-metering system, as shown in FIG. 9. It has an inlet port valve 81 for regulating an inflow rate of fuel into a cylinder to control a metered amount of fuel discharged. The other is a high-pressure fuel pump 90 of a system that is termed pre-stroke control, as shown in FIG. 10, where an inlet port valve 91 is controlled according to the pre-stroke way.

The high-pressure fuel pump 80 shown in FIG. 9 is a type of fuel pump to spray the pressurized fuel at a high pressure into the combustion chambers of the engine, in which a fuel introduced through a fuel inlet passage 82 when the inlet port valve 81 is kept open is pressurized in a pump chamber 85 by the action of a reciprocating pump plunger 84 actuated by an eccentric cam 83, which is driven by a power-take-off shaft of the engine. The pressurized fuel is then delivered to either a common fuel rail or injectors through a fuel discharge passage 86. According to the type as described just above, the metered amount of fuel discharged is determined depending on the inflow rate of fuel that flows through a valve seat for a pre-selected time during which the inlet port valve 81 is kept open.

In contrast, the high-pressure fuel pump 90 illustrated in FIG. 10 operates with such systems that the inlet port valve remains open after the bottom top center of the pump plunger for a short time of delay until a volume confined between the pump plunger and its associated cylinder reaches a desired amount of fuel to be discharged. The instant the desired amount of fuel is reached in the pump chamber, the inlet port valve is closed and the metered amount of fuel, which has been trapped in the pump chamber defined by the cylinder on the plunger, is delivered out of the pump chamber. Thus, excess fuel in the pump chamber is left returned through the inlet port valve until the pump chamber defined by the cylinder on the plunger is made reduced in volume to the desired amount of fuel to be discharged.

In the high-pressure fuel pump 90, the plunger 94 moves up and down as a cam 93 rotates, thereby varying the volume in the pump chamber 95. On descendent movement of the plunger 94, the pump chamber 95 is increased in volume while reduced in pressure, resulting in opening the inlet port valve 91 of a solenoid-actuated valve to admit the fuel into the pump chamber through a fuel inlet line 92. The inflowing fuel is not under the high pressure, but at a relatively low-pressure anticipated by a low-pressure supply pump. The pump chamber is initially sufficient large in volume compared with the desired amount of fuel to be discharged. As the cam 93 starts to rotate, the plunger 94 lifts to reduce the pump chamber 95 in its volume with the inlet port valve 91 still remaining open. Thus, the fuel admitted in the pump chamber 95 is partly forced to return through the inlet port valve 91 to the fuel inlet passage 92. The instant the amount of fuel in the pump chamber 95 has reached the desired amount of fuel, the inlet port valve 91 is closed. Thereafter as the plunger 94 continues to move upwardly, the fuel metered in the pump chamber 95 is forcible discharged to a fuel delivery port 96.

Disclosed in Japanese Patent Laid-Open No. 257533/1994 is a prior fuel-injection pump of pre-stroke control system, in which a back-pressure chamber supplied with a low-pressure fuel is provided behind a main valve body partly forming walls of a pump chamber. The fuel pressure in the back-pressure chamber is controlled by opening and closing between the back-pressure chamber and a subsidiary valve chamber by the action of a solenoid-actuated subsidiary valve, which is held for sliding movement in the subsidiary valve chamber. A piston section of the main valve body moves in a reciprocating manner in compliance with the combination of an urging force of a main valve spring and a pressure difference between the back-pressure chamber and an area in a main valve chamber, which communicates with a fuel passage or is exposed to the pump chamber, to thereby let the main valve body open and close between the back-pressure chamber and the subsidiary valve chamber. No fuel in the pump chamber is discharged backwards to the fuel passage at an earlier portion of lift of the plunger. Energization of the solenoid-actuated valve, nevertheless, regulates the timing for closure of the main valve body that allows the pressure to escape from the back-pressure chamber. This controls the effective stroke of the plunger after the back-pressure chamber has been disconnected from the pump chamber in a compressively forcing phase of the plunger.

Another conventional high-pressure fuel-injection pump of pre-stroke control system is disclosed in Japanese Patent No. 2,690,734. In accordance with this prior high-pressure fuel-injection pump, electric conduction of a solenoid-actuated valve makes a valve body block up a passage formed between the valve body and its valve seat for interconnecting a pump chamber with a low-pressure passage. Fuel in the pump chamber is raised in pressure by means of a compression member and then discharged to a common fuel-rail through a delivery port. Varying an electric conductive duration to the solenoid-actuated valve results in controlling the amount of fuel delivered to the common fuel-rail. The solenoid-actuated valve includes an outwardly-opening poppet-type valve body that is exposed at its entire lower surface against the pressure created in the pump chamber. Thus, the fuel pressure created in the pump chamber acts on the valve body as a motive force to effectively urge the valve body against its valve seat at closure event, in addition to the electromagnetic attractive force of the solenoid-actuated valve, to thereby aid the solenoid-actuated valve in ensuring the intensified closure power, resulting in keeping the pressure against any leakage past the valve at the closure event.

With most high-pressure fuel pumps of inlet port-metering system, on the other hand, a negative pressure developed ahead of the inlet port valve raises a major disadvantage of unsteady operation of the inlet port valve, which might occur due to cavitation or a sudden change in pressure. It has been thus required to eliminate the possible negative pressure ahead of the inlet port valve or keep the pressure ahead of the valve on any positive pressure. This, however, makes the inlet port valve complicated in structure. In conventional flow rate control of pre-stroke system to drive directly the inlet port valve connecting the pump chamber with the low-pressure side, moreover, the inlet port valve has to be actuated against the fuel pressure elevated up to a high pressure in the pump chamber and, therefore, it is inevitably required to make large the elastic force of a spring and the electromagnetic force of a solenoid-actuated valve to operate the inlet port valve. This leads to the large size of the solenoid-actuated valve, which might contribute to plague drawbacks of noise pollution and power-hungry consumption. In contrast, where the inlet port valve is operated, indirectly with making use of the low pressure fuel, by the energization of the solenoid-actuated valve, a control mechanism of using the low-pressure fuel is arranged between the solenoid-actuated valve and the inlet port valve. This design may likewise result in a bulky high-pressure fuel pump. With either system of direct or indirect operation of the inlet port valve, the drawbacks are the same as described just above: the solenoid-actuated valve becomes bulky in size while the control mechanism for the inlet port valve is made large-sized and complicated. In addition, the prior inlet port valve is apt to become unsteady in its operation to cause a jump in the amount of fuel delivered or an unfavorable problem of the marked pressure fluctuation occurring in the amount of fuel delivered out of the high-pressure pump. To cope with this, a damping mechanism is required to make steady the operation of the inlet port valve. Nevertheless, this causes the disadvantageous increase in the production cost of the high-pressure fuel pump.

Moreover, the high-pressure fuel pumps of pre-stroke control system operate usually to allow the fuel returning to the fuel-supply pump that may be considered the primary side. Accordingly, the fuel-supply pressure, or 3 to 8kg/ $cm^2$, disappears in pumping loss. The solenoid-actuated valve for the inlet port valve 91 sometimes raises another problem in which the inlet port valve when assembled renders the fuel pump too large in height, thereby making it even tougher to mount the inlet port valve on the engine. That is to say, the inlet port valve 91 is needed to provide the great attractive or compressive force to compress the fuel up to the high pressure. This leads to the large size of windings or coils with the result of making the solenoid-actuated valve bulky.

For providing the solenoid-actuated valve compact in structure and improved in noise pollution as well as power consumption, accordingly, it will be favorable for the high-pressure pumps to let the inlet port valve operate with making use of the pressure inherent in the fuel pressurized at a low pressure by the fuel-supply pump, instead of directly operating the inlet port valve by the energization of the solenoid-actuated valve for intermittently opening and blocking the fuel passage of low-pressure side to the pump chamber. Directly using the low-pressure fuel for opening and closure of inlet port valve, moreover, results in making as compact as possible in size the valve-operating mechanism for the inlet port valve, which is arranged between the solenoid-actuated valve and the inlet port valve, whereby the high-pressure fuel pump may be designed reduced in its overall height.

SUMMARY OF THE INVENTION

To overcome the problems as set forth above, therefore, a primary object of the present invention is to provide a high-pressure fuel pump having a solenoid-actuated valve of smaller equivalent size whereby a control valve is made compact in structure, reduced in noise under operation as well as diminished in power consumption. Thus, the present invention may make it easy to mount the high-pressure fuel pump on the engine.

The present invention is concerned with a variable-delivery high-pressure fuel pump comprising, a pump chamber varying in volume as a plunger moves in and out, an inlet port valve forming at a one end thereof a part of chamber walls of the pump chamber, the inlet port valve being opened when a low-pressure fuel is admitted into the pump chamber from a fuel inlet passage, while being closed when the admitted fuel is delivered out of the pump chamber, a control chamber defined on an opposing end of the inlet port valve to receive therein the low-pressure fuel applied through the fuel inlet passage, and a control valve for intermittently opening and blocking a fluid communication between the control chamber and the fuel inlet passage.

In accordance with the high-pressure fuel pump constructed as described above, the control chamber is formed on the top end of the inlet port valve and controlled in the pre-stroke way as the control valve is turned on and off. The fuel pressure of a low-pressure fuel applied with the fuel-supply pump is introduced into the control chamber, where the fuel pressure acts hydraulically on the inlet port valve, either directly or indirectly through any simple means. Moreover, the control chamber, when isolated with the closure of the control valve, may be made a hydraulic stiffness. Thus, the inlet port valve remains opened owing to the stiffness of the control chamber even during the plunger moves in or upwards. This allows the fuel in the pump chamber to flow backwards into the fuel inlet passage so that no fuel may be delivered at high pressure. In the event the fuel in the pump chamber is flowing backwards into the fuel inlet passage according to the upward movement of the plunger, the instant the control valve is opened, the inlet port valve is relieved from the pressure acting in the direction to open the inlet port valve and, thus moved to its closure position. With the inlet port valve coming in closure, the fuel pressure in the pump chamber is elevated up to a high pressure. Thereafter, the fuel pressure in the pump chamber begins to rise and the fuel intensified in fuel pressure is delivered out of the pump chamber, past the fuel delivery line during the delivery stroke of the plunger. Control of the timing the control valve is made open results in controlling the timing for closure of the inlet port valve to thereby regulate the amount of fuel delivered out of the pump chamber. The timing the inlet port valve is closed depends on any pressure balance among the intake pressure, resilient force of the compression spring for the inlet port valve and hydraulic pressure in the control chamber. During the plunger is moving in or upwards to thereby boost the fuel pressure in the pump chamber, the inlet port valve remains open against the force owing to the fuel pressure in the pump chamber acting in the direction of pushing upwards the inlet port valve.

In an aspect of the present invention, a variable-delivery high-pressure fuel pump is provided, wherein the inlet port valve is of a poppet-type valve made with a valve head having a valve face moving off and reseating against a valve seat in the pump chamber, and a valve stem integral with the valve head and extended out of the pump chamber into the control chamber. As an alternative, the inlet port valve is of a poppet-type valve made with a valve head having a valve face moving off and reseating against a valve seat in the pump chamber, and a valve stem integral with the valve head and extended out of the pump chamber, and the control chamber contains therein an intermediate piston that comes in abutment with the valve stem of the inlet port valve. With the modification the intermediate piston is incorporated, the control chamber is defined on the top of the intermediate piston instead of the valve stem of the inlet port valve.

In a design where the intermediate piston is made separately from the inlet port valve and they are assembled together, any measure should be adopted at the face-to-face abutment between the intermediate piston and the valve stem of the inlet port valve to help ensure the steady operation of them at high speed. To this end, the intermediate piston is formed in a concavity at lengthwise one end face thereof kept on abutment with valve stem, which is formed in a convexity at lengthwise one end thereof kept on abutment with the intermediate piston. In this case, moreover, the concavity on the intermediate piston and the convexity on the valve stem are of parts of a concave shpericity and a convex shpericity, respectively, and the concave shpericity is made larger in its radius of curvature than the convex shpericity.

In another aspect of the present invention, a variable-delivery high-pressure fuel pump is provided, wherein the control valve is of a solenoid-actuated valve. Moreover, it is preferred that the control valve is of a two-way valve. The solenoid-actuated valve may control the fuel pressure in the pump chamber with high response characteristic in compliance with control signals issued from any electronic control unit. The closure of the control valve lets the control chamber isolate fluid-tightly. In contrast, opening the control valve allows the control chamber to make fluid communication with the low-pressure side.

In another aspect of the present invention, a variable-delivery high-pressure fuel pump is provided, which regulates a timing for opening the control valve as the plunger moves from bottom dead center to top dead center of its stroke, to thereby control a timing for closure of the inlet port valve, resulting in metering an amount of fuel delivered out of the pump chamber. Control of the timing a signal to energize the control valve is turned off results in controlling the timing the position of the control valve causes the control chamber to open, that is, the timing the inlet port valve is made closed off and at the same time the fuel delivery out of the pump chamber begins. Possible control of the timing the fuel delivery begins makes it possible to meter the amount of fuel delivered out of the pump chamber per very delivery cycle of the fuel pump.

The high-pressure fuel pump of the present invention constructed as described above makes the inlet port valve open and close by the effect of low-pressure fuel applied from the fuel-supply pump. Only the control valve is, thus, sufficient to regulate the fuel supply of low-pressure fuel to the control chamber and the fuel relief out of the control chamber. As a result, smaller equivalent size of the control valve is realized with the reduction of noise on operation as well as the less consumption of electric power. Moreover, because of smaller equivalent size, it may become possible to make easy mount the fuel pump on the engine, according to the modification as to the arrangement of the fuel pump.

Other objects and features of the present invention will be more apparent to those skilled in the art on consideration of the accompanying drawings and following specification wherein are disclosed preferred embodiments of the invention with the understanding that such variations, modifications and elimination of parts may be made therein as fall within the scope of the appended claims without departing from the spirit of the invention.

DESCRIPTION OF THE PREFERRED EMBODIMENTS

Preferred embodiments of a variable-delivery high-pressure fuel pump according to the present invention will be explained in detail hereinafter with reference to the accompanying drawings.

Figure 1:
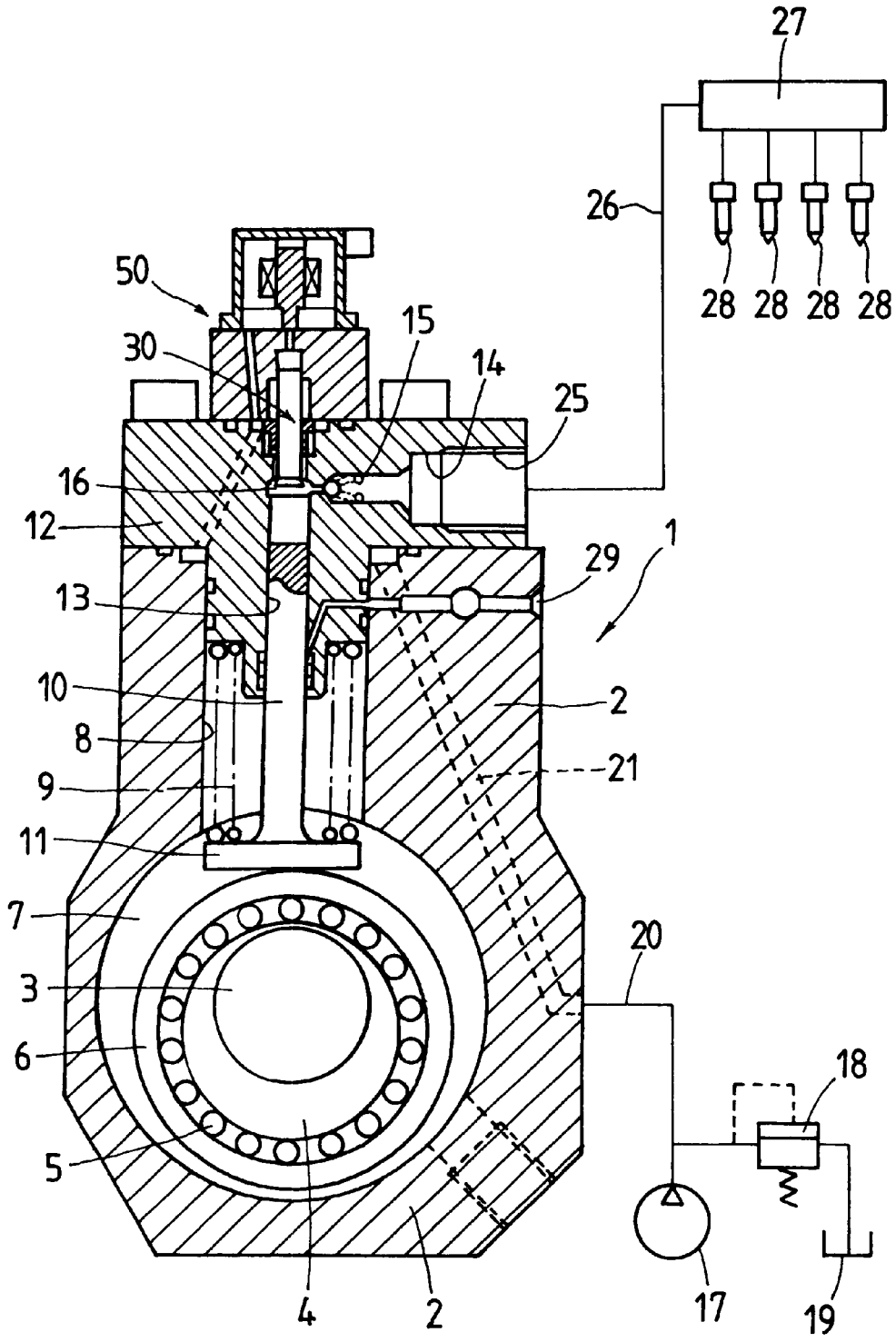
FIG. 1 is a general schematic view, partly in section, showing a preferred embodiment of a variable-delivery high-pressure fuel pump according to the present invention.

First referring to FIG. 1 showing schematically a variable-delivery high-pressure fuel pump 1 of the present invention, the high-pressure fuel pump 1 has a pump housing 2 where a camshaft 3 is supported for rotation. The camshaft 3 is driven from a crankshaft of an engine through suitable power transmissions such as belt drives. The camshaft 3 has thereon a cam 4, around the periphery of which a rotary ring 6 is fitted for rotation through bearings 5. The cam 4, bearings 5 and rotary ring 6 are all accommodated in a cam chamber 7 in the pump housing 2. A plunger 10 is arranged in a bore 8 in the pump housing 2 for linear reciprocating movement and urged against the rotary ring 6 by the elastic action of a plunger return spring 9. The plunger 10 terminates at its one end in tappet 11, which comes at its one surface in engagement with one end of the plunger return spring 9 while at the opposite surface in abutment with the rotary ring 6. Thus, the plunger return spring 9 urges elastically the tappet 11 against the rotary ring 6.

A barrel 12 is mounted on a top surface of the pump housing 2 and provided therein with a barrel bore 13 in which the plunger 10 fits for sliding movement. The barrel 12 is further made at an upper area thereof with a discharge port 14 extending sideways, where a delivery valve 15 of a check valve is arranged. The plunger 10 is accommodated for reciprocating movement in the barrel bore 13 of the barrel 12 in such a manner as to provide a pump chamber 16, which is defined in the upper area of the barrel bore 13 on the top of the plunger 10.

Fuel is delivered at a low pressure to a fuel line 20 from a fuel-supply pump 17 and then charged in a fuel reservoir 24, formed on the top surface of the pump housing 2, through a fuel passage 21 formed in the pump housing 2, an annular channel 22 formed at an interface of the pump housing 2 with the barrel 12, and a fuel inlet passage 23 extending upwardly through the pump housing 2 from the annular channel 22. The fuel line 20 branches to a by-pass line in which a relief valve 18 is arranged so that a fuel pressure over a preselected pressure level may be returned to a fuel tank 19 via the relief valve 18. The fuel reservoir 24 is communicated with the pump chamber 16 through an inlet port valve 30, as will be described in detail hereinafter.

The discharge port is made with threads 25, to which a fuel-delivery line 25 is coupled to lead the delivered fuel to a common fuel-rail 27. The fuel is intensified in pressure in the pump chamber 16 up to a high fuel-pressure, where the pressurized fuel forces the delivery valve 15 opening to thereby reach the common fuel-rail 27 through the fuel-delivery line 26. The high-pressure fuel may be applied to injectors 28 from the common fuel-rail 27. The fuel leaking out of the pump chamber 16 around the plunger 10 is recovered via a drain port 29, while being separated from the lubricating oil.

The barrel 12 is provided with the inlet port valve 30 to intermittently open and block a fluid communication between the pump chamber 16 and the fuel reservoir 24, and a control valve 50 to operate the inlet port valve 30. Combination of the inlet port valve 30 with the control valve 50 will be described below in conjunction with FIG. 2. The inlet port valve 30 has a valve head 31,arranged in the pump chamber 16, and a valve stem 32 extending out of the barrel 12 into the control valve 50. At closure event of the inlet port valve 30, a valve face 33 of the valve head 31 comes in abutment with a valve seat 34 to block the pump chamber 16 from the fuel reservoir 24. The valve stem 32 extends through a hole 35 in the barrel 12, with keeping an annular clearance 36 around the valve stem 34. Moreover, the valve stem 34 slide-fits in a guide hole 38 of a cylindrical bushing 37. It will be noted that the bushing 37 also has a function as a lower seat to bear a return spring 41 for the inlet port valve 30.

A snap ring 39 is fitted around the upper portion of the valve stem 32 while a spring guide 40, also serving as a spring bearing, is fitted on the valve stem 32. Thus, the snap ring 39 comes in engagement with the spring guide 40 to be kept against linear motion relatively of the valve stem 32. A compression spring 41 acting on the inlet port valve 30 is arranged between the bushing 31 and the compression spring 41 under compressed condition. As a result, the compression spring 41 urges forcibly the inlet port valve 30 towards its closure position, where the valve head 31 come in fluid-tight contact with its valve seat 34 to isolate reliably the pump chamber 16. A valve cap 42 is mounted on the barrel 12 to shield fluidtightly the fuel reservoir 24 through a sealing ring. The valve cap 42 is made therein with a central recess 43, where the valve stem 32 is received at the upper portion thereof. The valve stem 32 fits snugly at its top end 48 in a bore 44 in the valve cap 42, following passing through the guide hole 38 in the bushing 37, whereby the valve stem 32 may be ensured against becoming off-centre or eccentric, which might be otherwise happen due to the hydraulic pressure boosted in the pump chamber 16 when the plunger 10 lifts or moves in.

The valve cap 42 has at the center thereof the bore 44, in which the top end 48 of the valve stem 32 fits to define, in combination with inside walls of the bore 44, a control chamber 45 on the valve stem 32. Moreover, the valve cap 42 is made with a path 46 that is opened at one end thereof to the fuel reservoir 24. The path 46 is allowed to connect selectively with the control chamber 45 through a small passage, or fuel inlet port, 47 formed in a ceiling wall of the bore 44, so that the fuel pressure of low-pressure fuel applied from the fuel-supply pump 17 may reach the control chamber 45. The control valve 50 mounted fluid-tightly on the top face of the valve cap 42 is to provide a fluid communication between the path 46 and the small passage 47 and at the same time to open and close intermittently an open end of the small passage 47.

The control valve 50 has a valve housing 51 attached fluid-tightly to the top face of the valve cap 42 through a sealing ring. The control valve 50 includes a solenoid-actuated valve mainly composed of a solenoid 52 energized with signals issued from a controller unit, an armature 53 actuated in compliance with energization/deenergization of the solenoid 52, and a return spring 54 biasing the armature 53. The armature 53 terminates at its distal end in a valvular portion 55 acting as a two-way valve, which opens or closes the open end of the small passage 47 thereby making the control chamber 45 communicate with or isolate fluid-tightly from the low-pressure side. Upon energizing the solenoid 52, the armature 53 is forced to move downwards against the resilient force of the return spring 54 and, thus, the valvular portion 55 blocks the open end of the small passage 47, with resulting in keeping the control chamber 45 at a fluid-tightly isolated condition. In contract, when the solenoid 52 is deenergized, the armature 53 lifts by the action of the return spring 54 to open the small passage 47, through which the control chamber 45 is allowed to communicate with the low-pressure side.

Operation of the embodied fuel pump in FIGS. 1 and 2 will be explained below in conjunction with FIG. 3, which shows, in an exemplary way, timing relations on a common time-base abscissa of several variables in the high-pressure fuel pump embodying the present invention. FIG. 3(A) shows the "on-off" operation of a signal to actuate the control valve, or the solenoid-actuated valve. FIG. 3(B) is a graphic representation of the position of the control valve when operated in accordance with the signal in FIG. 3(A). FIG. 3(C) explains the lift of the inlet port valve when the control valve is operated as shown in FIG. 3(B), while FIG. 3(D) is a curve showing the position of the plunger in the high-pressure fuel pump. Finally, FIG. 3(E) is a graphic representation showing the amount of fuel delivered out of the high-pressure fuel pump.

The low-pressure fuel forced by the fuel-supply pump 17 flows through the fuel passage 21, annular channel 22 and fuel inlet passage 23, and then fed into the fuel reservoir 24. As will be seen from FIGS. 3(A) to (E), when the control valve 50 is kept on "turn-off", the armature 53 is urged by the action of the return spring 54 to its home position, where the valvular portion 55 opens the small passage 47 to help ensure the fluid connection through which the control chamber 45 is allowed to communicate with the low-pressure side. Thus, the control chamber 45 permits ingress and egress of the low-pressure fuel. As the plunger 10 moves downwards, the pump chamber 16 is reduced in pressure. As a result, the inlet port valve 30 is made open against the resilient force of the compression spring 41, depending on the force balance of the hydraulic pressures exerted on the inlet port valve 30. Thus, the fuel in the fuel reservoir 24 is admitted into the pump chamber 16 through over the valve face 33 of the valve head 31, which has been moved off the valve seat 34, after flowing through a slot 37*a* at the bottom of the bushing 37 and the annular clearance 36 provided around the valve stem 32 inside the hole 35. That is to say, the inlet port valve 30 moves to the direction where the valve face 33 moves off the valve seat 34 to permit the fuel to flow into the pump chamber 16. The instant $t_1$, the plunger 10 starts to move towards minus direction away from its reference point or neutral position, the actuating signal is turned on to energize the control valve 50. Thus, the control valve 50 begins at the timing $t_1$ to shift towards the closure and then continues the position until the timing $t_2$ the valvular portion 55 blocks completely the small passage 47 to isolate the control chamber 45. Therefore, the inlet port valve 30 ceases to lift towards its opening at the timing $t_2$ when the inlet port valve 30 is at its full-lift event. In this way, the fuel continues to enter the pump chamber 16 through the still-lifted or still-opened inlet port valve 30 for a length of time till the timing t3 the plunger 10 reaches the bottom dead center.

After the instant $t_3$ the plunger has reached the bottom dead center, the fuel in the pump chamber 16 is expelled as the plunger 10 moves from the bottom to the top of its stroke. With this event, the fuel in the control chamber 45 is kept from escaping out of the control chamber 45 and, therefore, the inlet port valve 30 is not allowed to close, but remains open. The passage 47 is made very small in its cross section. This enables a small or miniature solenoid to satisfactorily resist the fuel pressure in the control chamber 45. Thus, the fuel in the control chamber 45, even if boosted up to a high pressure, never thrusts upwards the armature 53 against the motive force of the solenoid 52. As a result, the pressurized fuel in the pump chamber 16 cannot be tolerated to open the delivery valve 15 leading to the fuel-delivery line 26, but may flow backwards to the low-pressure side such as the fuel inlet passage 23, fuel reservoir 24 and the like via the still-opened inlet port valve 30. The relief valve 18 works to return the tank 19 the amount of fuel equivalent with the fuel, which has flowed backwards to the low-pressure side such as the fuel inlet passage 23.

When the actuating signal applied to the control valve 50 is turned off at any instant $t_4$ the plunger is moving from the bottom to the top of its stroke, the armature 53 is relieved to move upwards under the influence of the resilient force of the return spring 54. This causes the valvular portion 55 to start opening the small passage 47. In consequence, the control valve 50 opens completely the control chamber 45 at the time $t_5$. On this event, since the control chamber 45 comes in fluid communication with the low-pressure side thereby lowering in pressure, the inlet port valve 30 moves upwards to begin closing under the pressure of fuel, which has been intensified in the pump chamber 16. The inlet port valve 30 is completely closed at the timing $t_6$. Following the beginning of the closure of the inlet port valve 30, thus, the fuel in the pump chamber 16 starts to cease from flowing backwards to the low-pressure side, and the resultant pressurized fuel in the pump chamber 16 is delivered beginning to the fuel delivery line 26 through the delivery valve 15. The pressurized fuel in the pump chamber 16 continues delivered to the fuel delivery line 26 till the instant $t_7$ the plunger 10 reaches the top dead center of its stroke.

Dotted curves in FIGS. 3(A) to (E) represent changes that might occur on the associated variables when having delayed the timing to switch the control valve 50 from "on" to "off". That is to say, when the timing the control valve 50 is turned off is delayed till the time $t_8$, the armature 53 of the control valve 50 is also retarded in its position. Thus, the timing the control valve 50 is opened beginning and the timing the inlet port valve 30 is closed beginning are both made delayed respectively, till the time $t_9$ and the time $t_{10}$. This inevitably causes a delay to the timing the pressurized fuel in the pump chamber 16 opens the delivery valve 15 to start delivered to the fuel delivery line 26, resulting in reducing the amount of fuel delivered out of the pump chamber 16 until the time $t_7$ the plunger 10 reaches the top dead center thereof. In contrast, even if the timing the control valve 50 is turned off is advanced, the closure of the control valve 50 is also advanced. Thus, the amount of fuel delivered out of the pump chamber 16 may be increased. In this way, shifting the timing to switch the control valve 50 from "on" to "off" may resulting in controlling the amount of fuel delivered out of the pump chamber 16.

Figure 4:
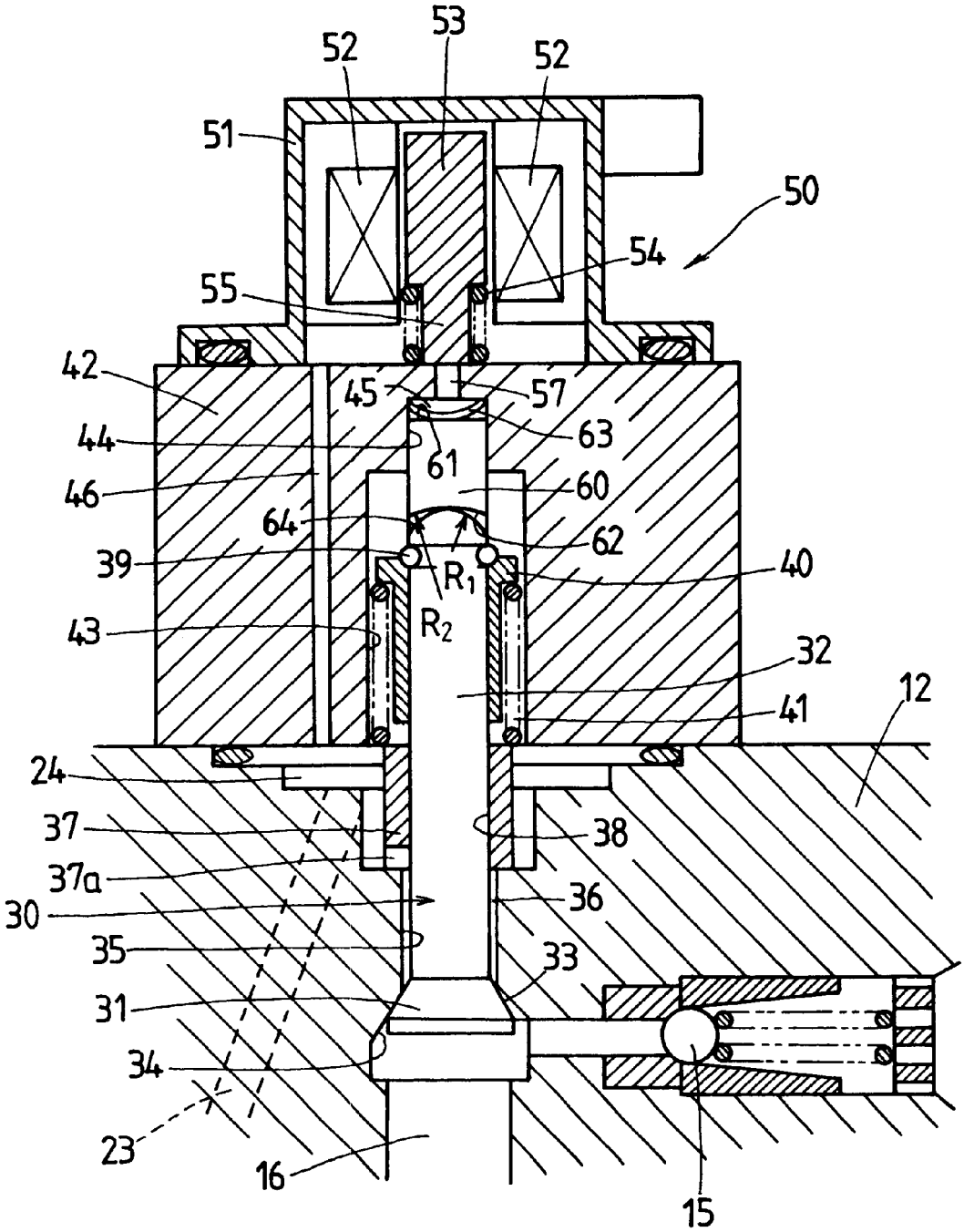
FIG. 4 is an enlarged fragmentary view in section showing the essential parts of another embodiment of the variable-delivery high-pressure fuel pump according to the present invention.
Figure 5:
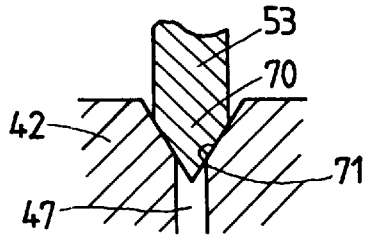
FIG. 5 is a fragmentary schematic section illustrating diverse modifications of a structure to open and close a connecting passage to a control chamber in the variable-delivery high-pressure fuel pump according to the present invention.
Figure 5:
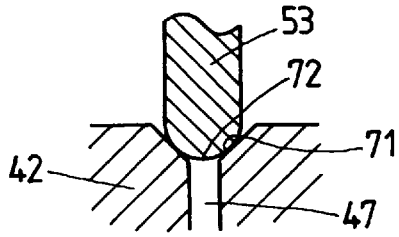
Figure 5:
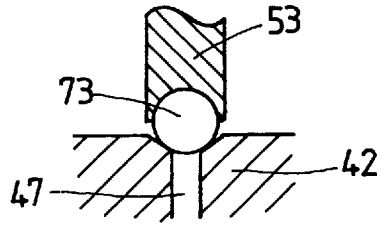
Figure 5:
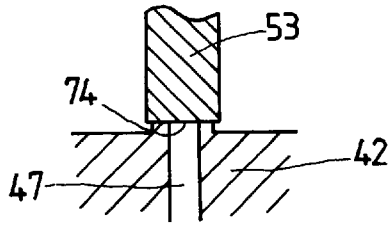
Figure 5:
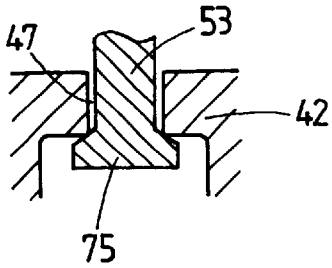

Another embodiment of the variable-delivery high-pressure fuel pump will be described with reference to FIG. 4. Except for the structure of the control chamber, this second embodiment of the variable-delivery high-pressure fuel pump shown in FIG. 4 is substantially identical in most components thereof, compared with the variable-delivery high-pressure fuel pump in FIGS. 1 and 2. Thus, the like reference numerals designate the components or parts identical or equivalent with that used in the variable-delivery high-pressure fuel pump in FIGS. 1 and 2, so that the previous description will be applicable.

Figure 2:
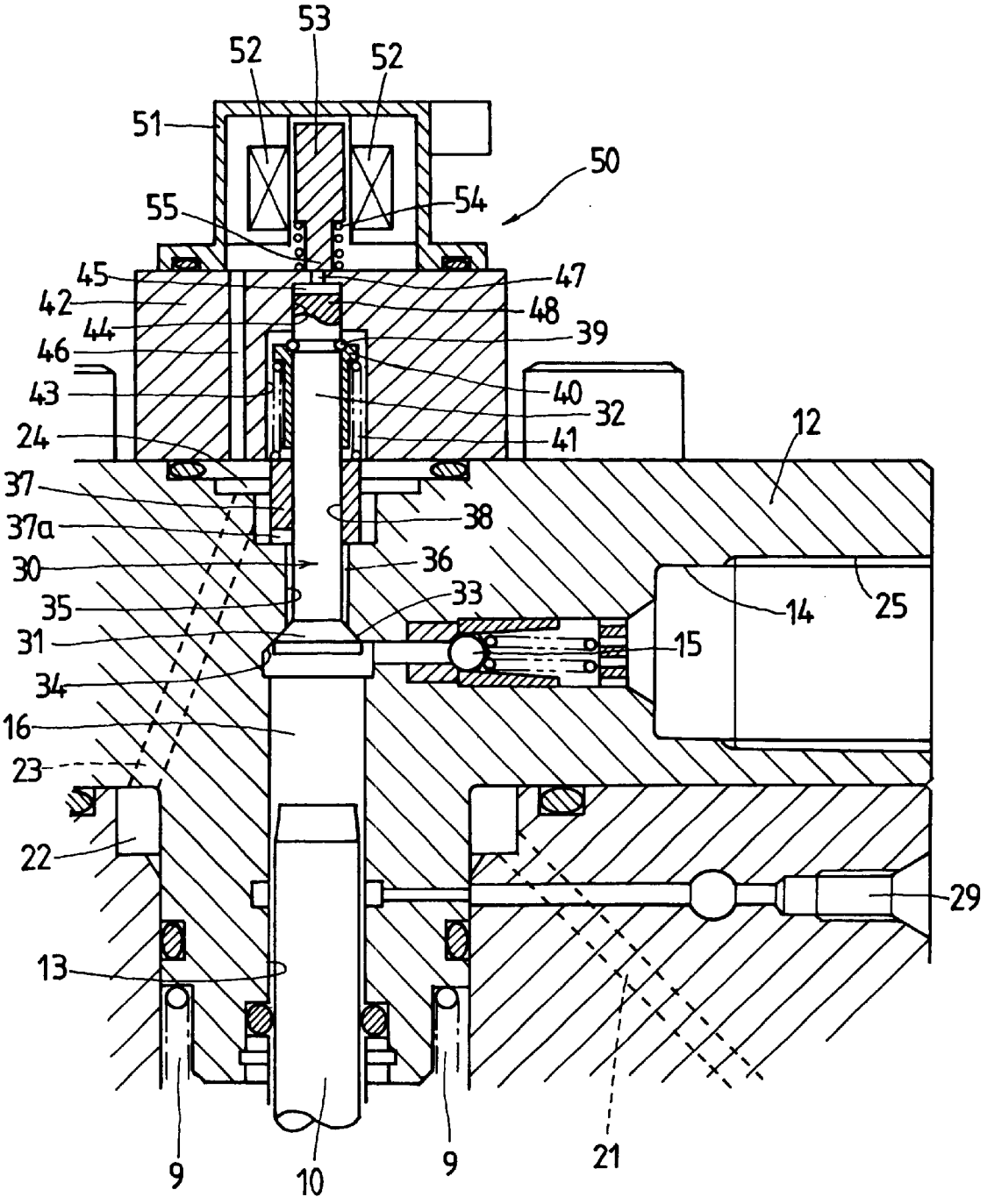
FIG. 2 is an enlarged fragmentary view in section of the essential parts of the high-pressure fuel pump shown in FIG. 1.
Figure 3:
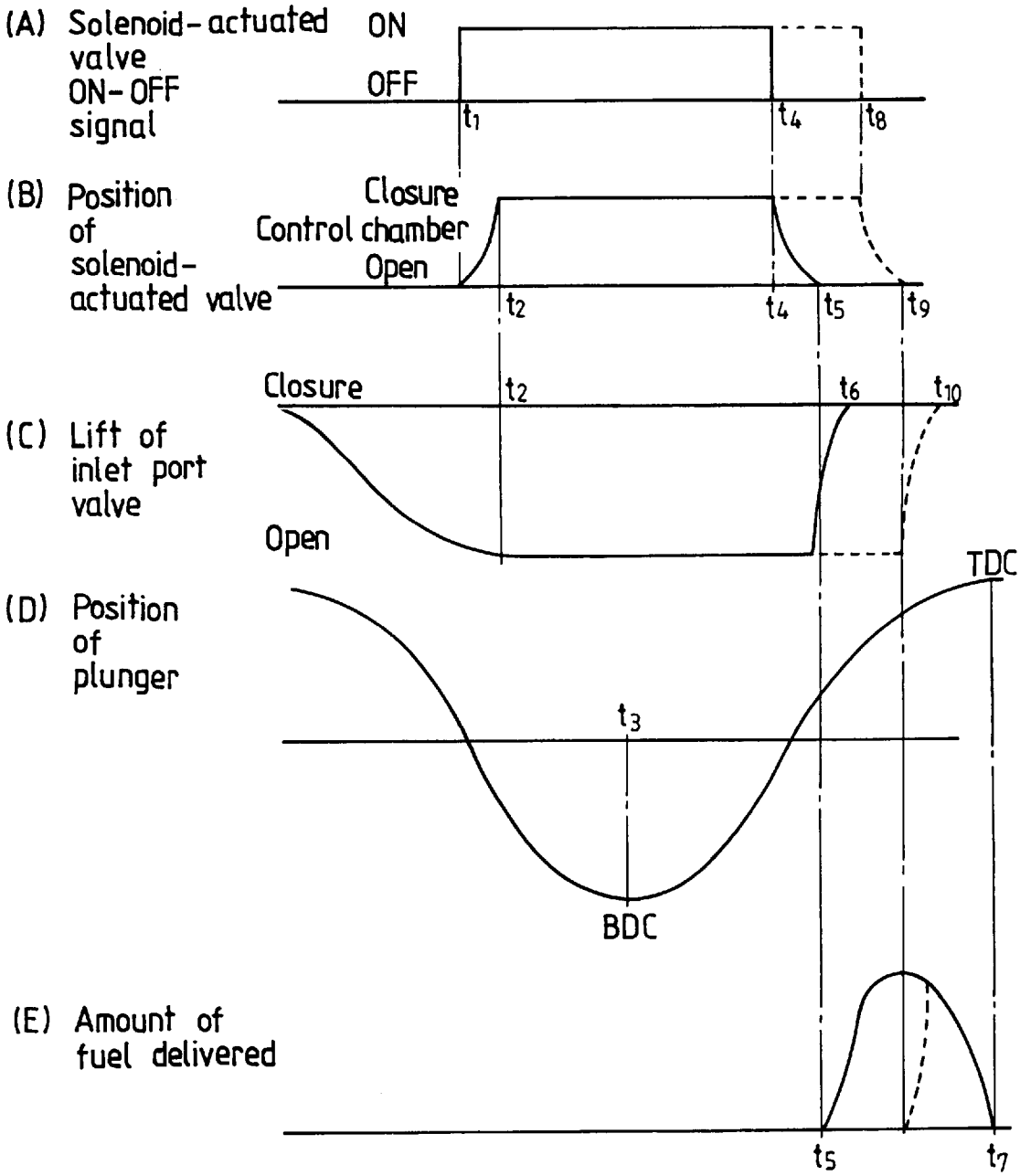
FIG. 3 is a composite chart showing a timing relation of several variables in the high-pressure fuel pump shown in FIG. 1.

The variable-delivery high-pressure fuel pump in FIGS. 1 and 2 has the control chamber defined in the bore 44 of the valve cap 42 on the top end 48 of the valve stem 32 of the inlet port valve 30, which fits in the bore 44, whereas the second embodiment has a control chamber 45 defined in the bore 44 of the valve cap 42 on a top face 61 an intermediate piston 60, which fits in the bore 44. The intermediate piston 60 is a component separate from the valve stem 32 of the inlet port valve 30 and comes in abutment with the upper end of the valve stem 32 of the inlet port valve 30.

Arranged in the control chamber 45 is a spring member 63 coming in engagement with the intermediate piston 60 to urge the piston 60 towards the valve stem 32 of the inlet port valve 30. As long as the reliable operation of the intermediate piston 60 is ensured, no spring member 63 may be necessary. The compression spring 41, or an inlet valve spring, is arranged under compression between the bushing 37, acting as a lower spring seat, and the spring guide 40 locked against falling off from the inlet port valve 30 by a snap ring 39, which is fitted on the upper area of the valve stem 32.

Energization of the control valve 50 drives at high speed both the intermediate piston 60 and the valve stem 32 of the inlet port valve 30. To help keep both the intermediate piston 60 and the valve stem 32 on alignment with each other, which operate in surface-to-surface contact to one another, the top face 64 of the valve stem 32 is formed in a convexity rising towards the intermediate piston 60, preferably in a part of a shpericity, while the bottom face 62 of the intermediate piston 60, confronting the valve stem 32 of the inlet port valve 30, is formed in a concavity, preferably in a part of a shpericity. When forming the confronting faces of the intermediate piston 60 and valve stem 32 in a part of the shpericity, the bottom face 62 on the intermediate piston 60 should be designed larger in the radius of concave curvature $R_2$ compared with the radius of convex curvature $R_1$ of the top face 64 of the valve stem 32. This design as to the radii of curvature on the confronting faces of the intermediate piston 60 and the valve stem 32 helps ensure the concentric alignment of the valve stem 32 with the intermediate piston 60, on either the event the intermediate piston 60 depresses the inlet port valve 30 along its centre axis or the reverse event the inlet port valve 30 lifts against the intermediate piston 60. Thus, this face-to-face abutment structure of the confronting curvatures contributes to keeping the valve stem 30 against off-centre from the intermediate piston 60, protecting the valve stem 32 against wobbling so that the inlet port valve 30 may operates with stability.

FIGS. 5(A) to (E) show modified profiles of structures where the armature 53 of the control valve 50 opens and closes the small holes 47 of the control chamber. In the profile in FIG. 5(A), the armature 53 terminates in a needle-type valve head 70 that fits with a chamfered edge 71 at the open end of the small passage 47. The structure in FIG. 5(B) includes the armature 53 formed at the distal end thereof a round valve head 72, which fits with the chamfered edge 71 at the open end of the small passage 47. In the structure in FIG. 5(C), the armature 53 is mounted at the end thereof with a ball 73, which fits with the chamfered edge 71 at the open end of the small passage 47. The structure in FIG. 5(D) has the armature 53 terminating in a flat valve face 74, which comes in abutment with a raised open end of the small passage 47. Finally in the structure shown in FIG. 5(E), the armature 53 terminates in poppet-type valve head 75 arranged in the control camber 45 so as to make contact with an open end of the small passage 47 inside the control chamber 45.

Figure 6:
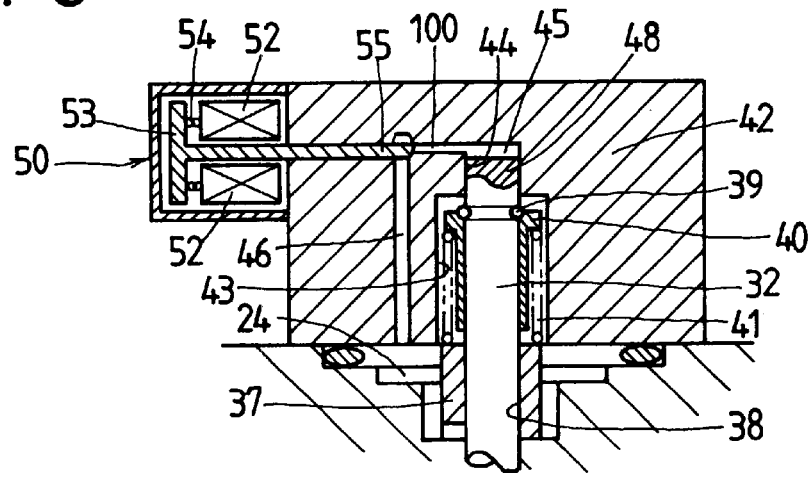
FIG. 6 is an enlarged fragmentary view in section showing the essential parts of another embodiment of the high-pressure fuel pump according to the present invention, in which a solenoid-actuated valve is arranged sideways of a valve cap.
Figure 7:
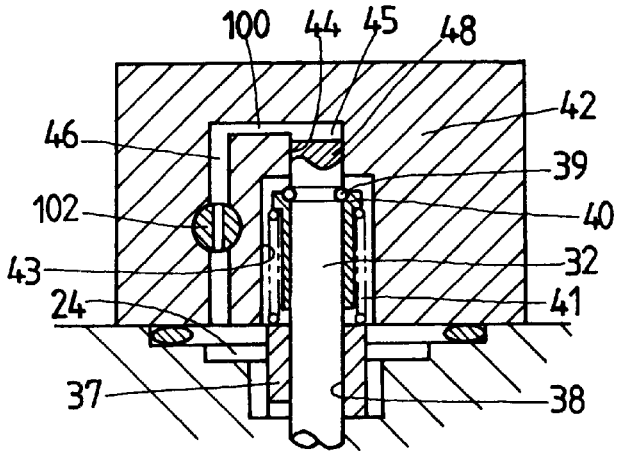
FIG. 7 is an enlarged fragmentary view in section showing the essential parts of another embodiment of the high-pressure fuel pump according to the present invention, in which a rotary valve is employed instead of the solenoid-actuated valve.
Figure 8:
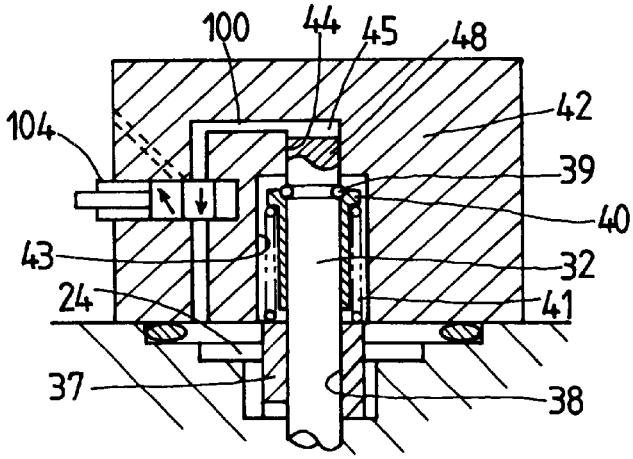
FIG. 8 is an enlarged fragmentary view in section showing the essential parts of a further another embodiment of the high-pressure fuel pump in accordance with the present invention, in which a spool valve is employed instead of the solenoid-operated valve.
Figure 9:
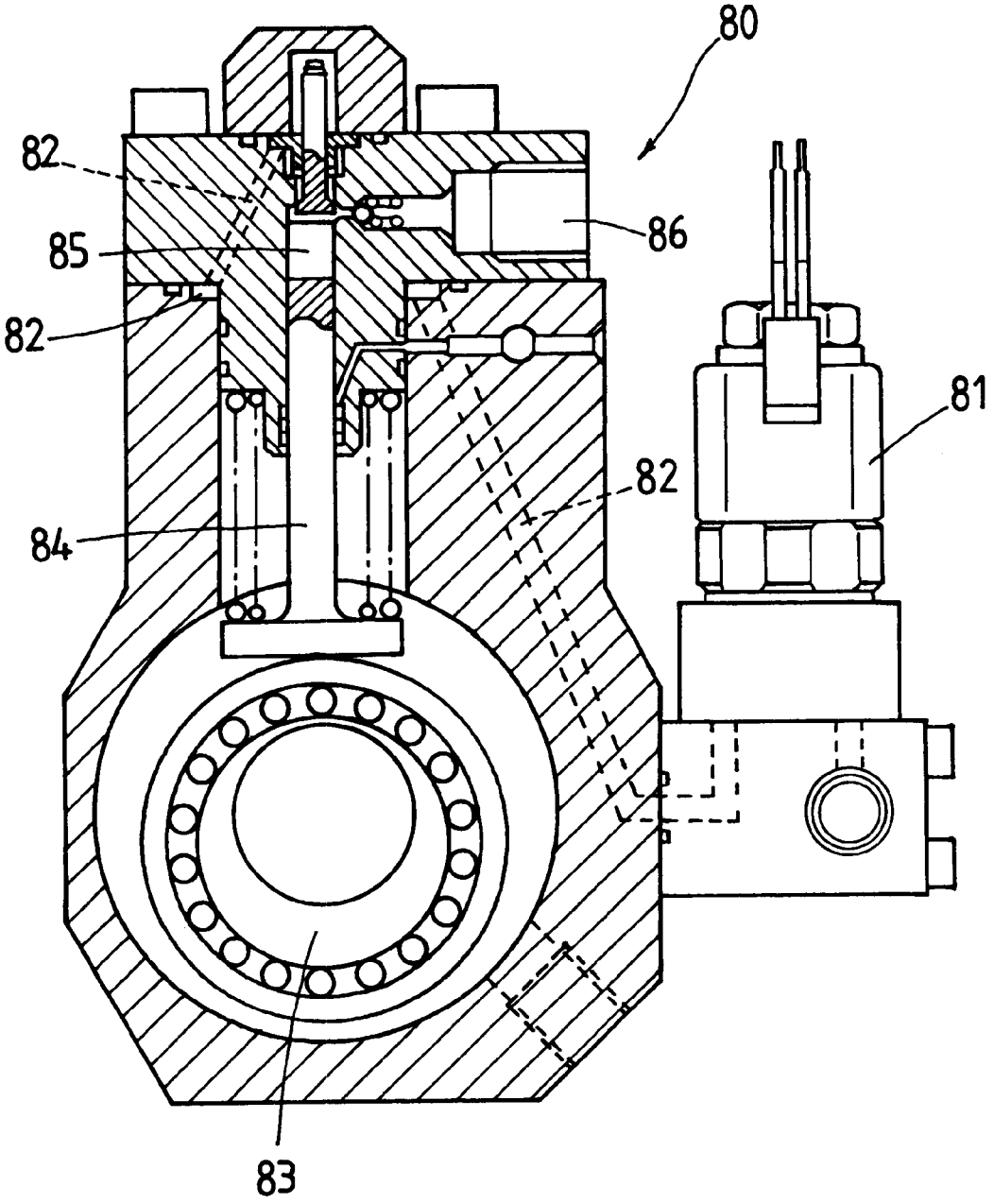
FIG. 9 (PRIOR ART)
FIG. 9 is a general schematic view, partly in section, showing a conventional high-pressure fuel pump of inlet port-metering system.
Figure 10:
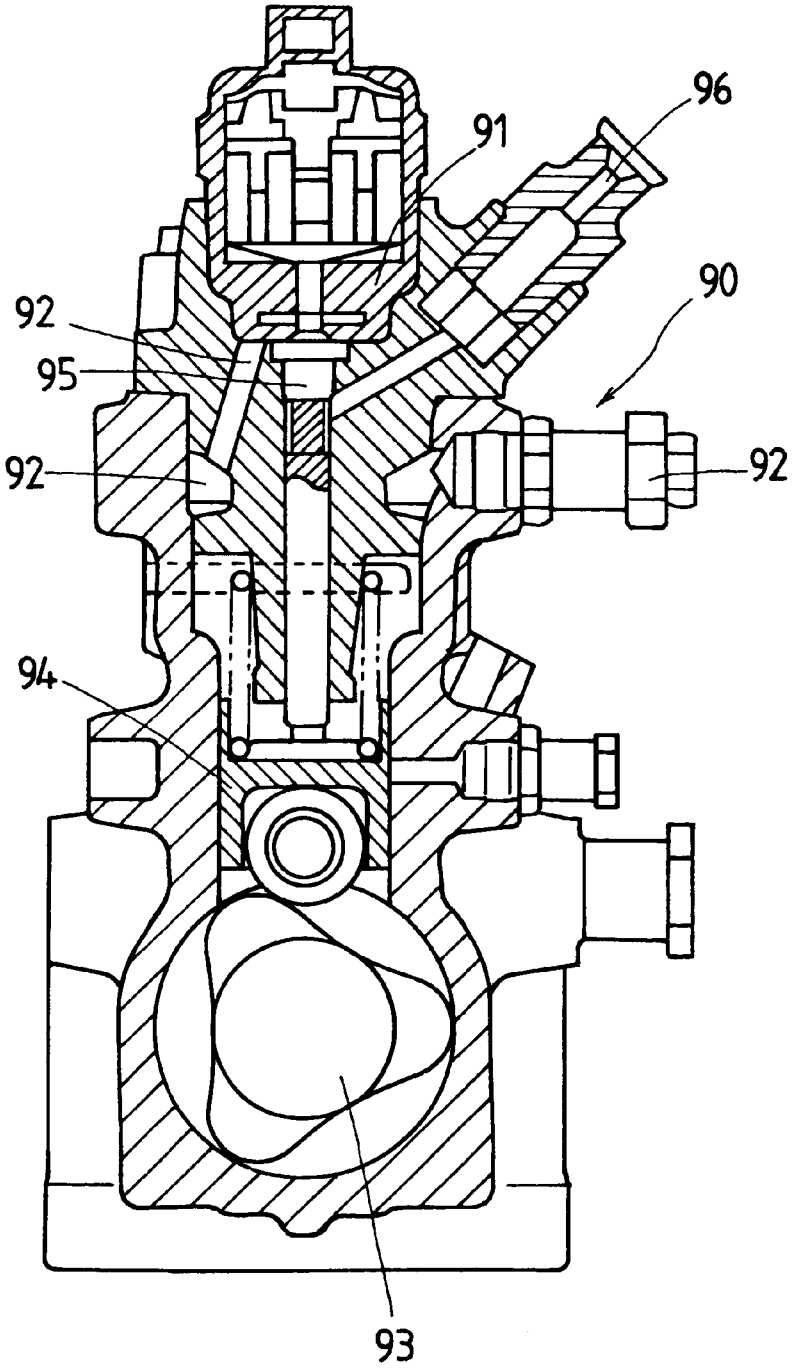
FIG. 10 (PRIOR ART)
FIG. 10 is a schematic view, partly in section, showing a conventional high-pressure fuel pump of pre-stroke control system.

In either embodiment constructed as described above, the control valve 50 is arranged just above the control chamber 45. Nevertheless, the embodied high-pressure fuel pumps are too tall in overall height to be snugly mounted as the pumps for fuel injection to the engine, which cannot be tolerated to provide a space enough in height. To reduce overall height of the fuel pump to make easy mount the fuel pump on the engine, it will be anticipated to arrange the control valve sideways the valve cap or modify the design of the control valve. FIG. 6 shows in section the essential parts of another embodiment of the variable-delivery high-pressure fuel pump, in which control valve 50 is arranged sideways of the valve cap 42. Next referring to FIG. 7 there is shown in section the essential parts of another embodiment of the variable-delivery high-pressure fuel pump, in which a rotary valve is employed instead of the solenoid-actuated valve. Moreover, FIG. 8 shows in section the essential parts of a further another embodiment of the variable-delivery high-pressure fuel pump, in which a spool valve is employed instead of the solenoid-operated valve. In the embodiments shown in FIGS. 6 to 8, the like reference numerals designate the components or parts identical or equivalent in their function with that used in the embodiments having been described above, so that the previous description will be applicable. In an embodiment shown in FIG. 6, a small passage 100 to communicate the control chamber 45 with the low-pressure side extends sidewise from the control chamber 45. The valvular portion 55 of the control valve 50 moves in and out, thereby intermittently open and close the fluid communication between the path 46 and the small passage 100. Another embodiment in FIG. 7 includes a rotary valve 102, which turns for intermittently opening and closing the fluid communication between the path 46 and the small passage 100. In a further another embodiment, finally, a spool valve 104 is provided which operates to open and close the fluid communication between the path 46 and the small passage 100.

As this invention may be embodied in several forms without departing from the spirit of essential characteristics thereof, the present embodiment is therefore illustrative and not restrictive, since the scope of the invention is defined by the appended claims rather than by the description proceeding them, and all changes that fall within meets and bounds of the claims, or equivalence of such meets and bounds are therefore intended to embraced by the claims.

What is claimed is:

1. A variable-delivery high-pressure fuel pump comprising, a pump chamber varying in volume as a plunger moves in and out, an inlet port valve forming at one end thereof a part of chamber walls of the pump chamber, the inlet port valve being opened when a low-pressure fuel is admitted into the pump chamber from a fuel inlet passage, while being closed when the admitted fuel is delivered out of the pump chamber, the inlet port valve being a poppet-type valve made with a valve head having a valve face moving off and reseating against a valve seat in the pump chamber, and a valve stem integral with the valve head, the valve stem having a top end, a control chamber constituted by a bore into which said valve stem top end is fitted snugly for sliding movement relative to said bore so that said valve stem top end defines one end of said control chamber, said control chamber having a fuel inlet port via which said control chamber receives low-pressure fuel applied through the fuel inlet passage, and a control valve for intermittently opening and closing said fuel inlet port so as to vary delivery of fuel from said pump chamber, wherein said valve stem top end engages in said bore so that said control chamber is isolated from said pump chamber whenever said control valve closes said fuel inlet port.

2. A variable-delivery high-pressure fuel pump constructed as defined in claim 1, wherein the control chamber contains therein an intermediate piston that comes in abutment with the valve stem of the inlet port valve.

3. A variable-delivery high-pressure fuel pump constructed as defined in claim 2, wherein the intermediate piston is formed in a concavity at lengthwise one end face thereof kept on abutment with valve stem, which is formed in a convexity at lengthwise one end thereof kept on abutment with the intermediate piston.

4. A variable-delivery high-pressure fuel pump constructed as defined in claim 3, wherein the concavity on the intermediate piston and the convexity on the valve stem are of parts of a concave shpericity and a convex shpericity, respectively, and the concave shpericity is made larger in its radius of curvature than the convex shpericity.

5. A variable-delivery high-pressure fuel pump constructed as defined in claim 1, wherein the control valve is of a solenoid-actuated valve.

6. A variable-delivery high-pressure fuel pump constructed as defined in claim 1, wherein the control valve is of a two-way valve.

7. A variable-delivery high-pressure fuel pump constructed as defined in claim 1, in which opening of the control valve is regulated with a timing that controls the timing of closure of the inlet port valve as the plunger moves from bottom dead center to top dead center of its stroke, thereby resulting in metering an amount of fuel delivered out of the pump chamber.

8. A variable-delivery high-pressure fuel pump constructed as defined in claim 1, wherein said valve stem top end closes one end of said bore for causing fuel present in said control chamber to produce a force that prevents closing of said inlet port valve when said control valve blocks fluid communication between the control chamber and the fuel inlet passage.

* * * * *